US010943759B2

(12) United States Patent
Ishii et al.

(10) Patent No.: US 10,943,759 B2
(45) Date of Patent: Mar. 9, 2021

(54) X-RAY TUBE

(71) Applicant: HAMAMATSU PHOTONICS K.K., Hamamatsu (JP)

(72) Inventors: Atsushi Ishii, Hamamatsu (JP); Ryosuke Yabushita, Hamamatsu (JP); Tutomu Inazuru, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/380,224

(22) Filed: Apr. 10, 2019

(65) Prior Publication Data

US 2019/0318901 A1 Oct. 17, 2019

(30) Foreign Application Priority Data

Apr. 12, 2018 (JP) ..... JP2018-076998

(51) Int. Cl.
*H01J 35/08* (2006.01)
*H01J 35/16* (2006.01)

(52) U.S. Cl.
CPC ..... *H01J 35/112* (2019.05); *H01J 35/16* (2013.01)

(58) Field of Classification Search
CPC ..... H01J 35/16; H01J 35/112; H01J 2235/16; H01J 35/04; H01J 2235/086
See application file for complete search history.

(56) References Cited

U.S. PATENT DOCUMENTS

| | | | | |
|---|---|---|---|---|
| 4,161,671 | A | 7/1979 | Klinkert | |
| 5,077,771 | A | 12/1991 | Skillicorn et al. | |
| 5,563,923 | A | 10/1996 | Okada et al. | |
| 6,229,876 | B1 | 5/2001 | Enck et al. | |
| 6,381,305 | B1 | 4/2002 | Okada et al. | |
| 7,734,015 | B2 | 6/2010 | Okada et al. | |
| 2003/0058995 | A1* | 3/2003 | Kutschera | H01J 35/10 378/144 |
| 2009/0238340 | A1* | 9/2009 | Okada | H01J 35/16 378/140 |
| 2016/0163497 | A1* | 6/2016 | Greenland | H01J 35/06 378/140 |

FOREIGN PATENT DOCUMENTS

| | | | |
|---|---|---|---|
| GB | 348934 | A | 5/1931 |
| JP | S39-12336 | Y | 5/1964 |
| JP | S52-20171 | U | 7/1975 |
| JP | 2003-132826 | A | 5/2003 |
| JP | 2007-103316 | A | 4/2007 |
| JP | 2016-111019 | A | 6/2016 |

* cited by examiner

*Primary Examiner* — Chih-Cheng Kao
(74) *Attorney, Agent, or Firm* — Faegre Drinker Biddle & Reath LLP

(57) ABSTRACT

An X-ray tube includes a vacuum housing, an electron gun, and an anode that includes a target emitting X-rays and a target supporting portion supporting the target. The target supporting portion has an anode main body portion and a protrusion portion including a side surface portion. The anode main body portion includes an outer circumferential surface extending in a direction of a tube axis, and a connection portion formed between the side surface portion of the protrusion portion and the outer circumferential surface. An angle formed by the outer circumferential surface and the connection portion is an obtuse angle.

27 Claims, 7 Drawing Sheets

X-RAY TUBE

TECHNICAL FIELD

An aspect of the present invention relates to an X-ray tube.

BACKGROUND

Japanese Unexamined Patent Publication No. 2007-103316, Japanese Unexamined Utility Model Publication No. S52-20171, and Japanese Unexamined Patent Publication No. 2016-111019 disclose technologies related to X-ray tubes. X-ray tubes generate X-rays by causing electrons to collide with a target. The technology disclosed in Japanese Unexamined Patent Publication No. 2007-103316 has focused on a focus of an electron gun on a target. The technology is related to a shape of an anode capable of forming a focus suitable for a target. The technology disclosed in Japanese Unexamined Utility Model Publication No. S52-20171 has focused on improvement of characteristics. The technology is related to amelioration of the shape of a target. The technology disclosed in Japanese Unexamined Patent Publication No. 2016-111019 is related to a method for assembling an X-ray assembly.

In order to cause electrons to collide with a target, an X-ray tube applies a voltage to an anode holding the target. An electric field corresponding to the voltage applied to the anode is generated around the anode. A voltage to be applied to the anode corresponds to energy of X-rays desired to be generated. For example, when obtaining high energy X-rays, a high voltage is applied to an anode. As a result, a potential difference between the anode and a vacuum housing accommodating the anode increases. Therefore, electric discharge is likely to occur between the anode and the vacuum housing.

An object of an aspect of the present invention is to provide an X-ray tube capable of curbing electric discharge.

SUMMARY

According to an aspect of the present invention, there is provided an X-ray tube including a vacuum housing; an electron gun that is accommodated in the vacuum housing and emits electrons; and an anode that includes a target which is accommodated in the vacuum housing, receives electrons provided from the electron gun, and emits X-rays, and a target supporting portion which supports the target. The target supporting portion has a main body portion having a columnar shape which extends in a direction of an axis line; and a protrusion portion including a side surface portion which extends in the direction of the axis line from the main body portion, and an inclined surface which is connected to the side surface portion, which intersects the axis line, and in which the target is disposed. The protrusion portion has a cross section intersecting the axis line with a smaller area than the main body portion. The main body portion includes an outer circumferential surface extending in the direction of the axis line, and a connection portion formed between the side surface portion of the protrusion portion and the outer circumferential surface. An angle formed by the outer circumferential surface and the connection portion is an obtuse angle.

DETAILED DESCRIPTION

Figure 1:
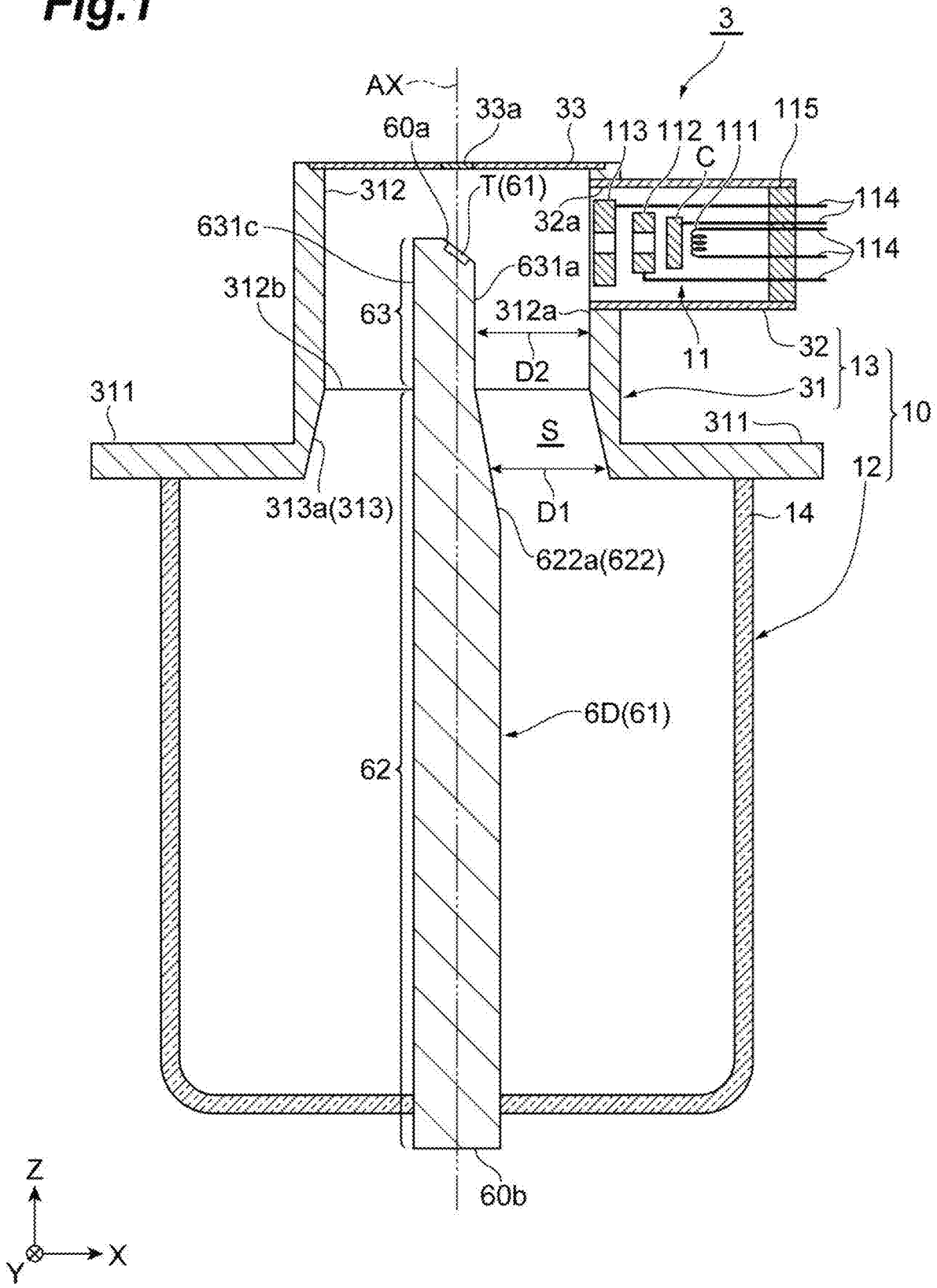
FIG. 1 is a cross-sectional view illustrating a configuration of an X-ray tube.

According to an aspect of the present invention, there is provided an X-ray tube including a vacuum housing; an electron gun that is accommodated in the vacuum housing and emits electrons; and an anode that includes a target which is accommodated in the vacuum housing, receives electrons provided from the electron gun, and emits X-rays, and a target supporting portion which supports the target. The target supporting portion has a main body portion having a columnar shape which extends in a direction of an axis line; and a protrusion portion including a side surface portion which extends in the direction of the axis line from the main body portion, and an inclined surface which is connected to the side surface portion, which intersects the axis line, and in which the target is disposed. The protrusion portion has a cross section intersecting the axis line with a smaller area than the main body portion. The main body portion includes an outer circumferential surface extending in the direction of the axis line, and a connection portion formed between the side surface portion of the protrusion portion and the outer circumferential surface. An angle formed by the outer circumferential surface and the connection portion is an obtuse angle.

The target supporting portion of the anode receives a voltage. The voltage generates an electric field around the target supporting portion. Electric discharge is likely to occur in a region having an electric field with a high intensity. In other words, electric discharge is likely to occur in a region having a significant potential difference per unit distance. In addition, the intensity of an electric field generated in a change portion increases as the change in the shape of the target supporting portion increases. The target supporting portion has the connection portion. The connection portion is formed between the side surface portion of the protrusion portion and the outer circumferential surface of the main body portion. The angle formed by the outer circumferential surface and the connection portion is an obtuse angle. A region from the main body portion to the protrusion portion is a shape change region. The connection portion moderates the change in the shape between the main body portion and the protrusion portion. When the change in the shape is moderated, the intensity of an electric field formed around the shape change region is deteriorated. As a result, electric discharge can be curbed.

In the X-ray tube, the side surface portion may include a main surface facing the electron gun, and a pair of side surfaces intersecting the main surface. The connection portion may include a first connection surface formed between the outer circumferential surface and the main surface, and a second connection surface formed between the outer circumferential surface and the side surface. An angle formed by the outer circumferential surface and the first connection surface may be an obtuse angle. An angle formed by the outer circumferential surface and the second connection surface may be an obtuse angle. According to this configuration, the main body portion is connected to the protrusion portion with a moderate angle. In other words, the main body portion is connected to the protrusion portion with no step therebetween. Therefore, electric discharge can be suitably curbed.

In the X-ray tube, the main body portion may include a first chamfered portion formed between the first connection surface and the second connection surface. According to this configuration, places having an acute angle at which electric discharge is likely to occur are reduced. Therefore, electric discharge can be further curbed.

In the X-ray tube, the protrusion portion may include a second chamfered portion formed between the main surface and the side surface. According to this configuration, places having an acute angle at which electric discharge is likely to occur are further reduced. Therefore, electric discharge can be further curbed.

In the X-ray tube; the main body portion may include a third chamfered portion formed between the first connection surface and the outer circumferential surface, and a fourth chamfered portion formed between the second connection surface and the outer circumferential surface. According to this configuration, places having an acute angle at which electric discharge is likely to occur are further reduced. Therefore, electric discharge can be more suitably curbed.

In the X-ray tube, the angle formed by the outer circumferential surface and the connection portion may be smaller than an angle formed by a distal end surface and the inclined surface. According to this configuration, the change in the shape between the main body portion and the protrusion portion is further moderated. Therefore, electric discharge can be suitably curbed.

In the X-ray tube, the axis line may be a center axis line of the main body portion. The target may be disposed at a position intersecting the axis line. According to this configuration, the accuracy of positioning the electron gun with respect to the target is enhanced. Therefore, electron beams can be incident on the target such that desired conditions are satisfied.

In the X-ray tube, the vacuum housing may include a metal housing portion which is formed of a metal and accommodates at least a part of the protrusion portion and the main body portion. The metal housing portion may include an inner circumferential surface portion facing the connection portion. The inner circumferential surface portion may be inclined with respect to the axis line to correspond to an inclination of the connection portion. According to this configuration, the intensity of an electric field generated in the vicinity of the connection portion is further reduced. Therefore, occurrence of electric discharge can be suitably curbed.

According to the aspect of the present invention, it is possible to provide an X-ray tube capable of curbing occurrence of electric discharge.

Hereinafter, an embodiment for performing the present invention will be described in detail with reference to the accompanying drawings. The same reference signs are applied to the same elements in description of the drawings, and duplicated description will be omitted. In addition, terms indicating predetermined directions such as "up" and "down" are used for the sake of convenience based on the states illustrated in the drawings.

A configuration of an X-ray tube 3 will be described. As illustrated in FIG. 1, the X-ray tube 3 is a so-called reflective X-ray tube. The X-ray tube 3 includes a vacuum housing 10, an electron gun 11, and a target T. The vacuum housing 10 is a vacuum envelope internally maintaining a vacuum state. The electron gun 11 is an electron generation unit. The electron gun 11 has a cathode C. For example, the cathode C has a base body which is formed of a high melting-point metal material or the like and a substance which has been impregnated in the base body and easily emits electrons. The target T has a plate shape. For example, the target T is formed of a high melting-point metal material such as tungsten. A position at the center of the target T overlaps a tube axis AX of the X-ray tube 3. The electron gun 11 and the target T are accommodated inside the vacuum housing 10. Electrons emitted from the electron gun 11 are incident on the target T. As a result, the target T generates X-rays. The generated X-rays are radiated outside through an X-ray emission window 33*a*.

The vacuum housing 10 has an insulation valve 12 and a metal portion 13. The insulation valve 12 is formed of an insulating material. Examples of an insulating material include glass. The metal portion 13 has the X-ray emission window 33*a*. The metal portion 13 has a main body portion 31 (metal housing portion) and an electron gun accommodation portion 32. The main body portion 31 accommodates the target T serving as an anode. The electron gun accommodation portion 32 accommodates the electron gun 11 serving as a cathode.

The main body portion 31 has a tubular shape. The main body portion 31 has an inner space S. A lid plate 33 is fixed to one end portion (outer end portion) of the main body portion 31. The lid plate 33 has the X-ray emission window 33*a*. The material of the X-ray emission window 33*a* is an X-ray transmission material. Examples of an X-ray transmission material include beryllium and aluminum. The lid plate 33 closes one end side of the inner space S. The main body portion 31 has a flange portion 311, a cylinder portion 312, and a tapered portion 313. The flange portion 311 is provided in the outer circumference of the main body portion 31. The flange portion 311 is fixed to an X-ray generation device (not illustrated). The cylinder portion 312 is formed on one end portion side of the main body portion 31. The cylinder portion 312 has a cylindrical shape. The tapered portion 313 is connected to the other end portion of the cylinder portion 312. The tapered portion 313 is increased in diameter while going away from the cylinder portion 312 in a tube axis direction (Z-direction) of the X-ray tube 3. That is, the inner diameter is increased while going away from the cylinder portion 312 in the tube axis direction (Z-direction) of the X-ray tube 3.

The electron gun accommodation portion 32 has a cylindrical shape. The electron gun accommodation portion 32 is fixed to a side portion of the main body portion 31 on one end portion side. The center axis line of the main body portion 31 is substantially orthogonal to the center axis line of the electron gun accommodation portion 32. In other words, the tube axis AX of the X-ray tube 3 is substantially orthogonal to the center axis line of the electron gun accommodation portion 32. An opening 32*a* is provided in an end portion of the electron gun accommodation portion 32 on the main body portion 31 side. The inside of the electron gun accommodation portion 32 communicates with the inner space S of the main body portion 31 through the opening 32*a*.

The electron gun 11 includes the cathode C, a heater 111, a first grid electrode 112, and a second grid electrode 113. In the electron gun 11, the beam diameter of an electron beam generated in cooperation with the constituent components can be reduced. In other words, the electron gun 11 can perform micro-focusing of an electron beam. The cathode C, the heater 111, the first grid electrode 112, and the second grid electrode 113 are attached to a stem substrate 115 with a plurality of power feeding pins 114 interposed therebetween. The plurality of power feeding pins 114 extend in a manner of being parallel to each other. The cathode C, the heater 111, the first grid electrode 112, and the second grid electrode 113 receive electric power from the outside with the corresponding power feeding pins 114 interposed therebetween.

The insulation valve 12 has a substantially tubular shape. One end side of the insulation valve 12 is connected to the main body portion 31.

The other end side of the insulation valve 12 holds an anode 61 (target supporting portion 60). The target supporting portion 60 has a columnar shape. For example, the target supporting portion 60 is formed of a copper material or the like. The target supporting portion 60 extends in the Z-direction. An inclined surface 60*a* is formed at the distal end of the target supporting portion 60. The inclined surface 60*a* is inclined away from the electron gun 11 while going from the insulation valve 12 side toward the main body portion 31 side. The target T is buried in an end portion of the target supporting portion 60. The target T is flush with the inclined surface 60*a*.

A proximal end portion 60*b* of the target supporting portion 60 protrudes outward beyond a lower end portion of the insulation valve 12. The proximal end portion 60*b* of the target supporting portion 60 is connected to a power source. In the present embodiment, the vacuum housing 10 has the ground potential. Therefore, the metal portion 13 has the ground potential. The target supporting portion 60 receives a high positive voltage from the power source. The target supporting portion 60 may receive a voltage from the power source in a form different from a high positive voltage.

Hereinafter, with reference to FIGS. 2A, 2B, and 3, the anode 61 included in the X-ray tube 3 will be described in more details. The anode 61 has the target supporting portion 60 and the target T.

The target supporting portion 60 has a protrusion portion 63 and an anode main body portion 62. The protrusion portion 63 includes the inclined surface 60*a*. The anode main body portion 62 includes the proximal end portion 60*b* (refer to FIG. 1). The target supporting portion 60 is an integrated component. The target supporting portion 60 is cut out from one rod material through lathe working or the like.

The anode main body portion 62 has a rod shape. The anode main body portion 62 extends in a direction of the tube axis AX from the proximal end portion 60*b*. The anode main body portion 62 has a columnar shape. The protrusion portion 63 is connected to the distal end side of the anode main body portion 62. The protrusion portion 63 has a rod shape. The protrusion portion 63 extends in the direction of the tube axis AX from the distal end of the anode main body portion 62. The anode main body portion 62 has a columnar shape. On the other hand, the protrusion portion 63 has a substantially quadrangular prism shape. The proximal end side of the protrusion portion 63 is connected to the distal end of the anode main body portion 62. The inclined surface 60*a* is provided at the distal end of the protrusion portion 63.

The anode main body portion 62 has a rod-shaped portion 621 and a connection portion 622. The rod-shaped portion 621 is formed on the proximal end side. That is, the rod-shaped portion 621 is formed on the proximal end portion 60*b* side. The rod-shaped portion 621 includes an outer circumferential surface 621*a* of the anode main body portion 62. The anode main body portion 62 has a columnar shape.

The protrusion portion 63 includes a side surface portion 631, the inclined surface 60*a*, and a distal end surface 632. The side surface portion 631 extends in the direction of the tube axis AX. The inclined surface 60*a* obliquely intersects the tube axis AX. The distal end surface 632 is orthogonal to the tube axis AX. The side surface portion 631 further includes a main surface 631*a*, a first side surface 631*b*, a curved side surface 631*c*, and a second side surface 631*d*. The main surface 631*a*, the first side surface 631*b*, and the second side surface 631*d* are flat surfaces. On the other hand, the curved side surface 631*c* is a curved surface.

The main surface 631*a* faces the electron gun 11. The curved side surface 631*c* is a surface on a side opposite to the main surface 631*a*. The first side surface 631*b* and the second side surface 631*d* are surfaces extending between the main surface 631*a* and the curved side surface 631*c*.

Figure 4:
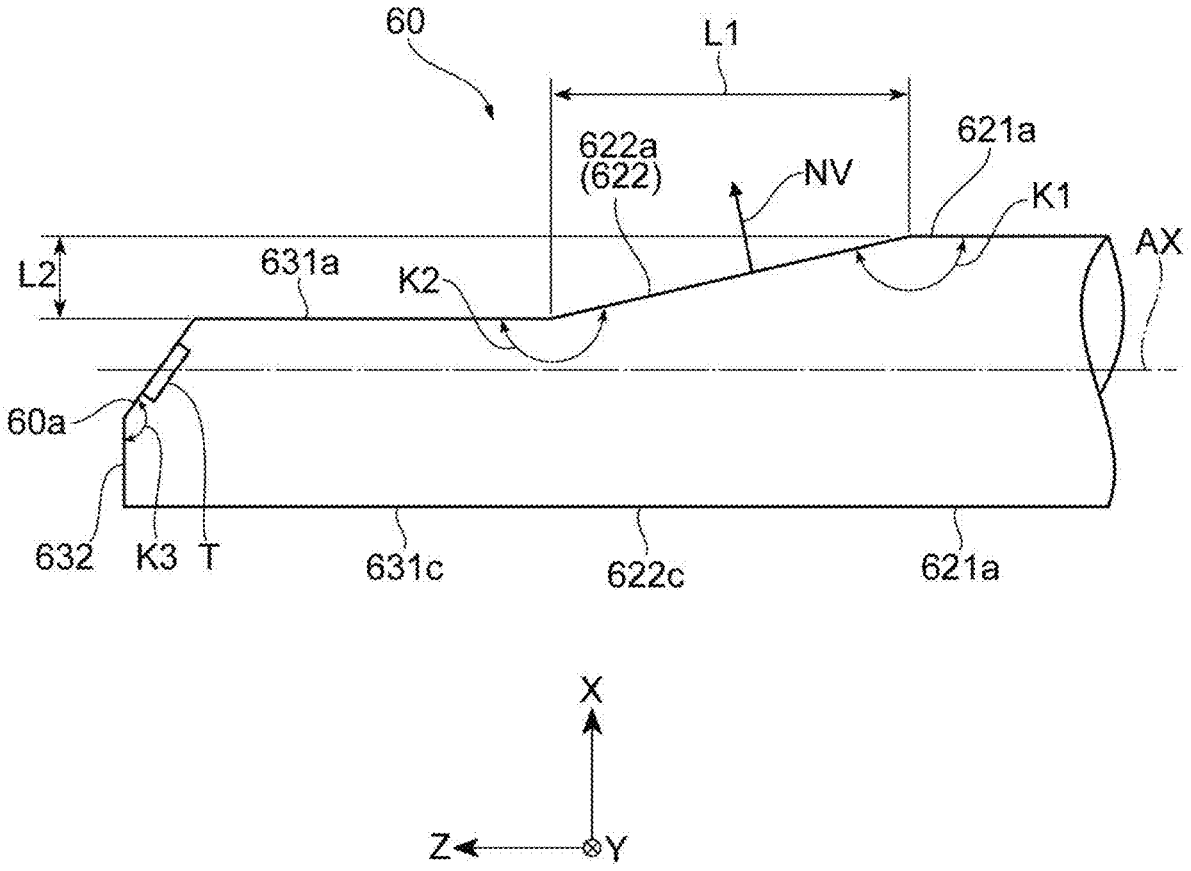
FIG. 4 is a view illustrating the shape of the main portion of the anode.

The anode main body portion 62 and the protrusion portion 63 are viewed from the side (refer to FIG. 4). The curved side surface 631*c* is a part of a columnar surface connected to the outer circumferential surface 621*a* with no change in the shape. That is, the curved side surface 631*c* is included in the same curved surface as the outer circumferential surface 621*a*. In other words, in the direction of the tube axis AX, there is no difference between the heights of the curved side surface 631*c* and the outer circumferential surface 621*a*. In other words, there is no step between the curved side surface 631*c* and the outer circumferential surface 621*a*. The "height" is the length in a direction orthogonal to the tube axis AX. The distance from the tube axis AX to the curved side surface 631*c* is equivalent to the distance from the tube axis AX to the outer circumferential surface 621*a*.

The main surface 631*a* is not included in the same flat surface as the outer circumferential surface 621*a*. In other words, there is a difference between the heights of the main surface 631*a* and the outer circumferential surface 621*a*. That is, the distance from the tube axis AX to the main surface 631*a* differs from the distance from the tube axis AX to the outer circumferential surface 621*a*. In more details, the distance from the tube axis AX to the main surface 631*a* is shorter than the distance from the tube axis AX to the outer circumferential surface 621*a*. The same applies to the first side surface 631*b* and the second side surface 631*d*. The distance from the tube axis AX to the first side surface 631*b* is shorter than the distance from the tube axis AX to the outer circumferential surface 621*a*. The distance from the tube axis AX to the second side surface 631*d* is shorter than the distance from the tube axis AX to the outer circumferential surface 621*a*. The distance from the tube axis AX to the main surface 631*a*, the distance from the tube axis AX to the first side surface 631*b*, and the distance from the tube axis AX to the second side surface 631*d* may be equal to each other. In addition, the distance from the tube axis AX to the main surface 631*a*, the distance from the tube axis AX to the first side surface 631*b*, and the distance from the tube axis AX to the second side surface 631*d* may differ from each other.

According to such a configuration, electron beams to be provided by the electron gun 11 can be incident on the target T in a desired shape by forming the protrusion portion 63 in a predetermined shape. In a cross section intersecting the tube axis AX of the X-ray tube 3, the cross-sectional area of the anode main body portion 62 is larger than the cross-sectional area of the protrusion portion 63. Therefore, the anode main body portion 62 efficiently conducts heat. As a result, the anode main body portion 62 can radiate heat.

There is a difference between the heights of the outer circumferential surface 621*a* and the main surface 631*a*. A significant step corresponding to the difference between the heights at the maximum is present between the outer circumferential surface 621*a* and the main surface 631*a*. In order to prevent such a step, the target supporting portion 60 has the connection portion 622 provided in the anode main body portion 62. In other words, in order to reduce such a step as much as possible, the target supporting portion 60 has the connection portion 622 provided in the anode main body portion 62.

Figure 2A:
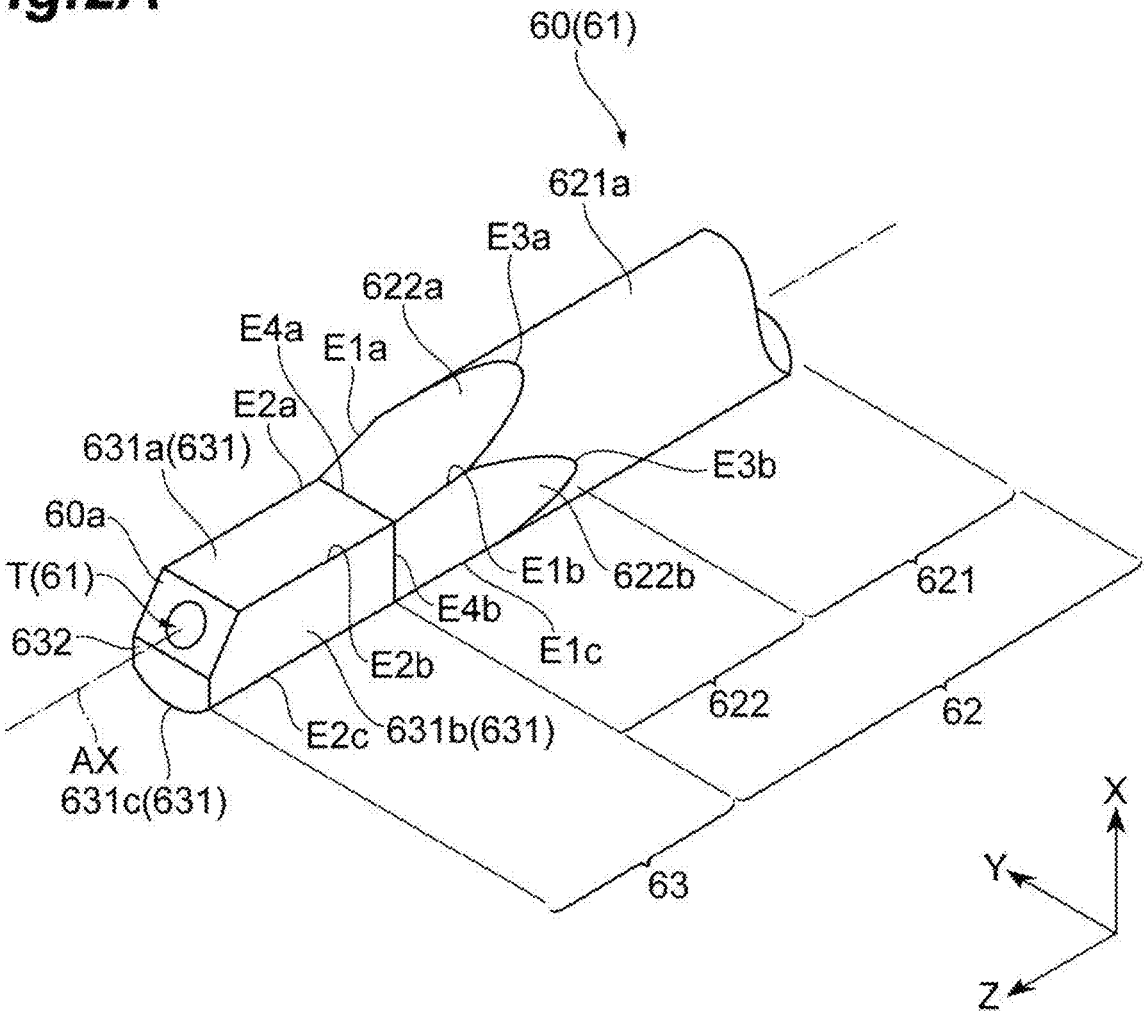
FIG. 2A is a perspective view illustrating an enlarged main portion of an anode.
Figure 2B:
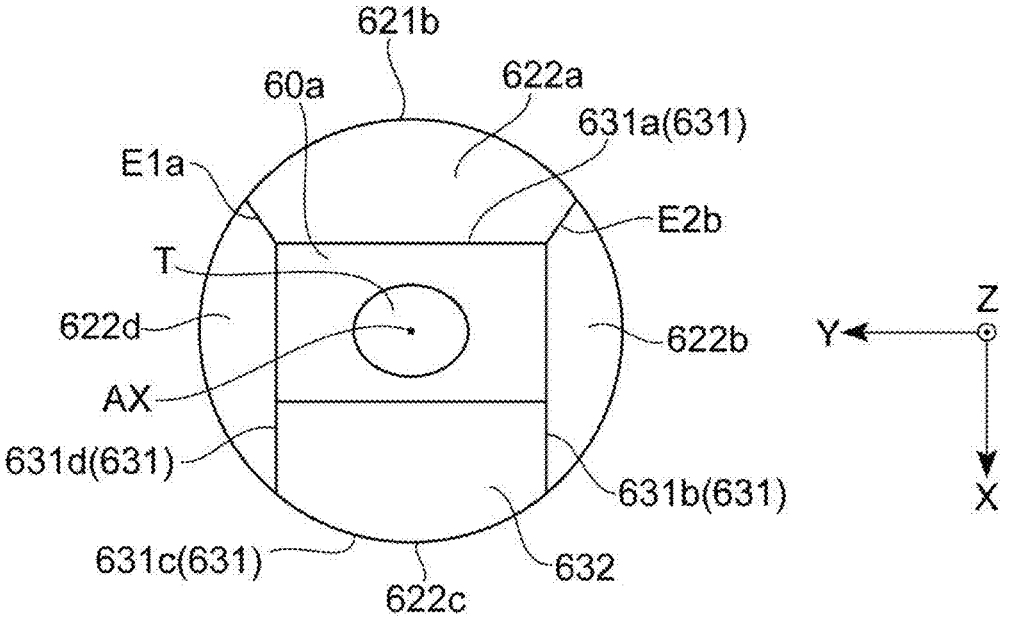
FIG. 2B is a front view illustrating the enlarged main portion of the anode.
Figure 3:
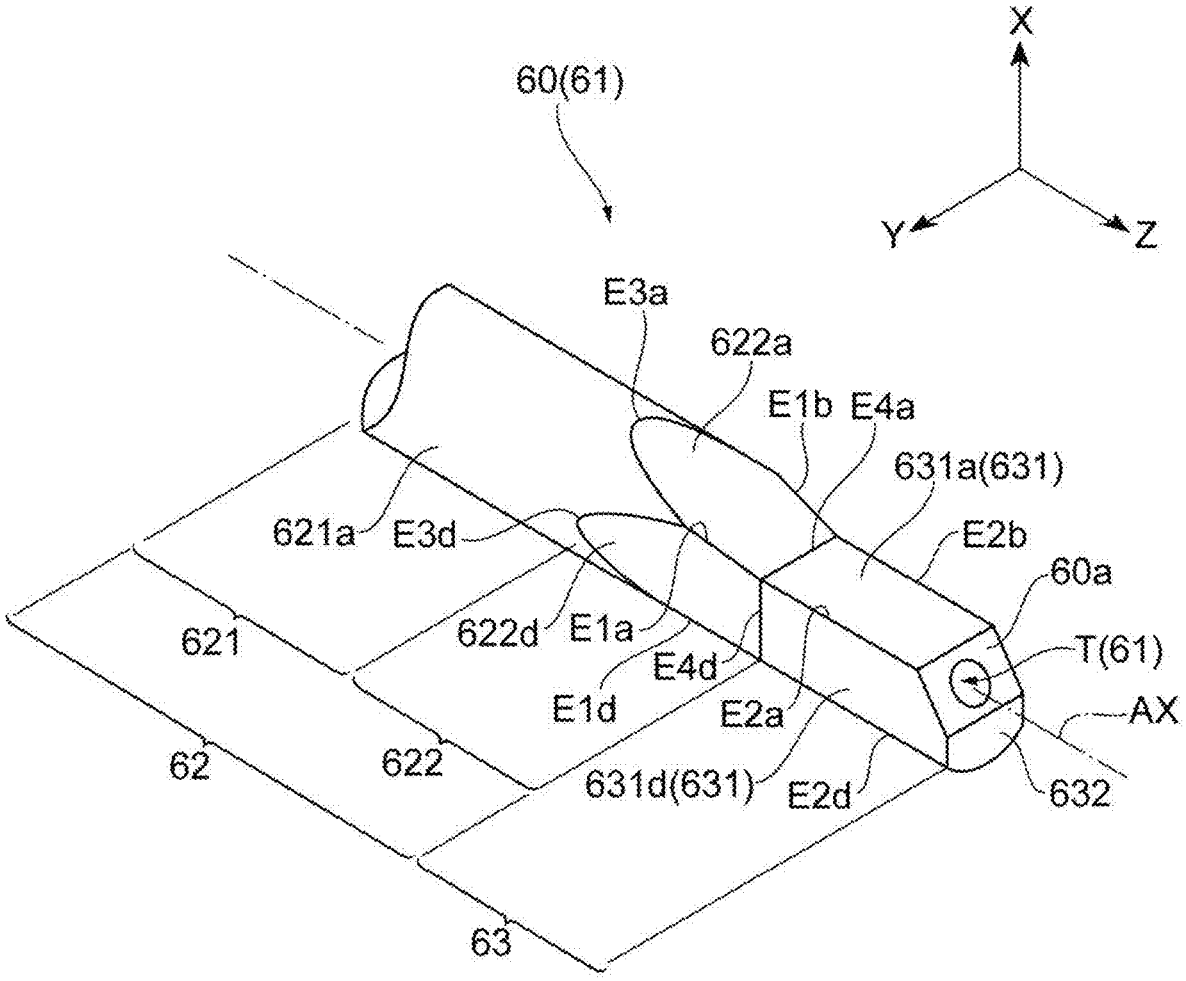
FIG. 3 is another perspective view illustrating the enlarged main portion of the anode.

With reference to FIGS. 2A, 2B, and 3, the connection portion 622 is formed on the distal end side of the anode main body portion 62. In other words, the connection portion 622 is formed on the protrusion portion 63 side of the anode main body portion 62. The connection portion 622 causes the outer circumferential surface 621*a* of the rod-shaped portion 621 and the side surface portion 631 of the protrusion portion 63 to be coupled to each other. In more details, the connection portion 622 includes a first connection surface 622*a*, a second connection surface 622*b*, a curved side surface 622*c* (refer to FIG. 2B), and a third connection surface 622*d* (refer to FIG. 3). In brief, the connection portion 622 has three inclined surfaces inclined with respect to the tube axis AX.

The first connection surface 622*a* causes the main surface 631*a* and the outer circumferential surface 621*a* to be coupled to each other. Specifically, the first connection surface 622*a* includes an edge portion E4*a* and an edge portion E3*a*. The edge portion E4*a* is shared by the first connection surface 622*a* and the main surface 631*a*. The edge portion E3*a* is shared by the first connection surface 622*a* and the outer circumferential surface 621*a*. The first connection surface 622*a* is a flat surface. The main surface 631*a* is also a flat surface. Therefore, the edge portion E4*a* to which the first connection surface 622*a* and the main surface 631*a* are connected forms a straight line. On the other hand, the first connection surface 622*a* is a flat surface, and the outer circumferential surface 621*a* is a flat surface. Therefore, the edge portion E3*a* to which the first connection surface 622*a* and the outer circumferential surface 621*a* are connected forms a curved line.

The second connection surface 622*b* causes the first side surface 631*b* and the outer circumferential surface 621*a* to be coupled to each other. Similar to the first connection surface 622*a*, the second connection surface 622*b* includes an edge portion E4*b* and an edge portion E3*b*. The edge portion E4*b* is shared by the second connection surface 622*b* and the first side surface 631*b*. The edge portion E3*b* is shared by the second connection surface 622*b* and the outer circumferential surface 621*a*. The third connection surface 622*d* causes the second side surface 631*d* and the outer circumferential surface 621*a* to be coupled to each other. Similar to the first connection surface 622*a*, the third connection surface 622*d* includes an edge portion E4*d* and an edge portion E3*d*. The edge portion E4*d* is shared by the third connection surface 622*d* and the second side surface 631*d*. The edge portion E3*d* is shared by the third connection surface 622*d* and the outer circumferential surface 621*a*.

With reference to FIG. 4. The first connection surface 622*a* is inclined with respect to the tube axis AX. In other words, the first connection surface 622*a* is not orthogonal to the tube axis AX. An angle K1 formed by the first connection surface 622*a* and the outer circumferential surface 621*a* is an obtuse angle. An angle K2 formed by the first connection surface 622*a* and the main surface 631*a* is also an obtuse angle. A normal vector NV of the first connection surface 622*a* will be stipulated. The direction of the normal vector NV is a direction facing the electron gun 11. More preferably, the inclination of the first connection surface 622*a* with respect to the tube axis AX is smaller than the inclination of the inclined surface 60*a* with respect to the tube axis AX. More preferably, a length L1 of the first connection surface 622*a* in the tube axis AX is longer than a length L2 of the first connection surface 622*a* in a direction intersecting the tube axis AX. Excluding the normal vector NV, the size relationship between the inclinations may be reversed in accordance with characteristics required for the X-ray tube 3.

A positional relationship between other components constituting the X-ray tube 3 and the anode 61 will be described. With reference to FIG. 1, the anode main body portion 62 and the protrusion portion 63 are disposed in a closed space. The closed space is surrounded by the insulation valve 12 and the metal portion 13.

A part of the anode main body portion 62 and the protrusion portion 63 are disposed inside the main body portion 31. Specifically, at least a part of the connection portion 622 of the anode main body portion 62 is disposed in a space surrounded by the tapered portion 313. The protrusion portion 63 is disposed in a space surrounded by the cylinder portion 312. That is, a boundary between the anode main body portion 62 and the protrusion portion 63 substantially corresponds to the position of a boundary between the cylinder portion 312 and the tapered portion 313. In other words, the position of the connection portion 622 substantially corresponds to the position of an edge portion 312*b*. In addition, the positions of the edge portions E4*a*, E4*b*, and E4*d* substantially correspond to the position of the edge portion 312*b*.

A tapered surface 313*a* of the tapered portion 313 faces each of the first connection surface 622*a*, the second connection surface 622*b*, the curved side surface 622*c*, and the third connection surface 622*d* constituting the connection portion 622 of the anode main body portion 62. The first connection surface 622*a*, the second connection surface 622*b*, and the third connection surface 622*d* are inclined with respect to the tube axis AX. A gap D1 between the first connection surface 622*a* and the tapered surface 313*a* is perpendicular to the tube axis AX. The length of the gap D1 is substantially uniform along the tube axis AX.

Each of the main surface 631*a*, the first side surface 631*b*, the curved side surface 631*c*, and the second side surface

631*d* of the protrusion portion 63 faces an inner circumferential surface portion 312*a* of the cylinder portion 312. The main surface 631*a*, the first side surface 631*b*, the curved side surface 631*c*, and the second side surface 631*d* are parallel to the tube axis AX. The cylinder portion 312 also extends along the tube axis AX. For example, a gap D2 between the main surface 631*a* and the inner circumferential surface portion 312*a* is perpendicular to the tube axis AX. The length of the gap D2 is substantially uniform along the tube axis AX. The gap between the first side surface 631*b* and the inner circumferential surface portion 312*a* in a direction perpendicular to the tube axis AX is uniform. The gap between the curved side surface 631*c* and the inner circumferential surface portion 312*a* in the direction perpendicular to the tube axis AX is uniform. The gap between the second side surface 631*d* and the inner circumferential surface portion 312*a* in the direction perpendicular to the tube axis AX is uniform.

For example, the distances of the gaps D1 and D2 may be equal to each other. According to such a configuration, on a side facing the electron gun 11, a uniform gap is provided between the anode 61 and the main body portion 31 formed of a metal. A space easily affected by electrons from the electron gun 11 is present inside the X-ray tube 3. According to the foregoing configuration, it is possible to stabilize an electric field generated in an easily affected space. Therefore, electric discharge is easily curbed.

[Operational effects] The target supporting portion 60 of the anode 61 receives a voltage. The voltage generates an electric field around the target supporting portion 60. Electric discharge is likely to occur in a region having an electric field with a high intensity. In other words, electric discharge is likely to occur in a region having a significant potential difference per unit distance. In addition, the intensity of an electric field generated in a change portion increases as the change in the shape of the target supporting portion 60 increases. The target supporting portion 60 has the connection portion 622. The connection portion 622 is formed between the side surface portion 631 of the protrusion portion 63 and the outer circumferential surface 621*a* of the anode main body portion 62. The angle formed by the outer circumferential surface 621*a* and the connection portion 622 is an obtuse angle. A region from the anode main body portion 62 to the protrusion portion 63 is a shape change region. The connection portion 622 moderates the change in the shape between the anode main body portion 62 and the protrusion portion 63. When the change in the shape is moderated, the intensity of an electric field formed around the shape change region is deteriorated. As a result, electric discharge can be curbed.

Figure 5A:
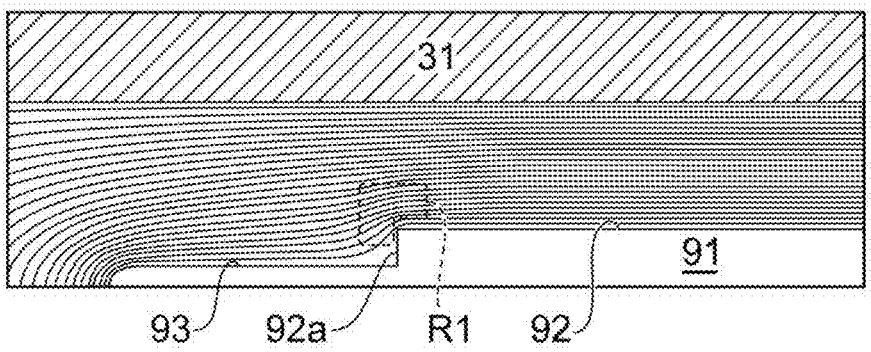
FIG. 5A is an analysis result of an electric field formed around an anode of a comparative example.
Figure 5B:
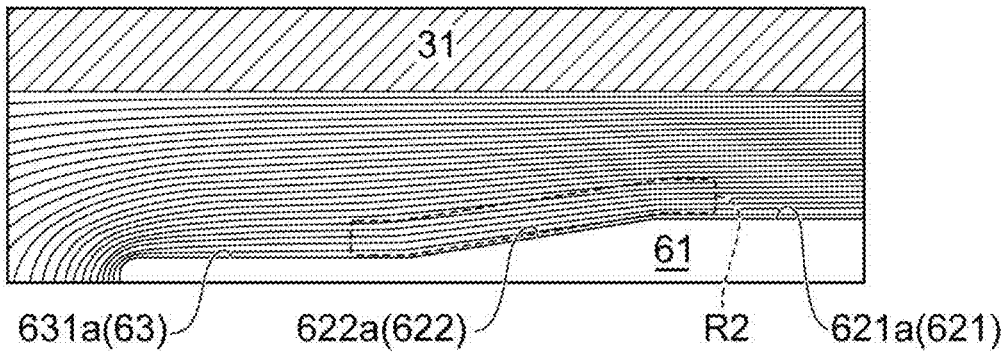
FIG. 5B is an analysis result of an electric field formed around an anode of an embodiment.

The effects of the connection portion 622 could be confirmed through numerical analysis. FIGS. 5A and 5B illustrate results of the numerical analysis of electric fields formed between the anode 61 and an anode 91, and the main body portion 31. FIG. 5A is an analysis result of an electric field formed by the anode 91 according to a comparative example. FIG. 5B is a result of an electric field formed by the anode 61 according to the embodiment. FIGS. 5A and 5B illustrate equipotential lines.

A protrusion portion 93 of the anode 91 of the comparative example is connected to an anode main body portion 92 with a connection surface 92*a* interposed therebetween. The connection surface 92*a* is orthogonal to the tube axis AX. An angle between the connection surface 92*a* and the outer circumferential surface of the anode main body portion 92 is a right angle. A region having narrow gaps between the equipotential lines is generated in the vicinity of such a corner portion. In other words, the potential changes suddenly in the vicinity of the corner portion. (refer to the region R1 in FIG. 5A). A sudden change of the potential indicates that the potential difference per unit distance is significant. In addition, a sudden change of the potential indicates that the intensity of an electric field is high. Electric discharge is likely to occur in a region in which such an electric field has been generated.

On the other hand, the anode 61 according to the embodiment has the inclined connection portion 622. In the anode 91 of the comparative example, a region having narrow gaps between the equipotential lines is present from the outer circumferential surface of the anode main body portion 92 to the main surface of the protrusion portion 93. However, from the results of the anode 61 according to the embodiment, it could be confirmed that a region having narrow gaps between the equipotential lines was unlikely to be generated (refer to the region R2 in FIG. 5B). Therefore, compared to the anode 91 of the comparative example, it could be confirmed that the potential difference per unit distance was small in the vicinity of the anode main body portion 62, the connection portion 622, and the protrusion portion 63. That is, compared to the anode 91 of the comparative example, it could be confirmed that the intensity of an electric field was low in the vicinity of the anode main body portion 62, the connection portion 622, and the protrusion portion 63. As a result, it was ascertained that electric discharge could be curbed.

The side surface portion 631 of the X-ray tube 3 includes the main surface 631*a*, the first side surface 631*b*, and the second side surface 631*d*. The main surface 631*a* faces the electron gun 11. Each of the first side surface 631*b* and the second side surface 631*d* is substantially orthogonal to the main surface 631*a*. The connection portion 622 includes the first connection surface 622*a*, the second connection surface 622*b*, and the third connection surface 622*d*. The first connection surface 622*a* is formed between the outer circumferential surface 621*a* and the main surface 631*a*. The second connection surface 622*b* is formed between the outer circumferential surface 621*a* and the first side surface 631*b*. The third connection surface 622*d* is formed between the outer circumferential surface 621*a* and the second side surface 631*d*. The angle K1 formed by the outer circumferential surface 621*a* and the first connection surface 622*a* is an obtuse angle. The angle formed by the outer circumferential surface 621*a* and the second connection surface 622*b* is also an obtuse angle. The angle formed by the outer circumferential surface 621*a* and the third connection surface 622*d* is also an obtuse angle. According to this configuration, the anode main body portion 62 is connected to the protrusion portion 63 with a moderate angle. The anode main body portion 62 is connected to the protrusion portion 63 with no step therebetween. Therefore, electric discharge can be suitably curbed.

In the X-ray tube 3, the outer circumferential surface 621*a* and the connection portion 622 form the angle K1. The distal end surface 632 and the inclined surface 60*a* form an angle K3. The angle K1 may be smaller than the angle K3. According to this configuration, the change in the shape between the anode main body portion 62 and the protrusion portion 63 is further moderated. Therefore, electric discharge can be suitably curbed.

In the X-ray tube 3, the center axis line of the anode main body portion 62 overlaps the tube axis AX. The target T is disposed at a position intersecting the tube axis AX. According to this configuration, electron beams can be incident on the target T such that desired conditions are satisfied.

In the X-ray tube 3, the vacuum housing 10 includes the main body portion 31 which is formed of a metal and accommodates at least a part of the protrusion portion 63 and the anode main body portion 62. The main body portion 31 includes the tapered surface 313*a* facing the connection portion 622. The tapered surface 313*a* is inclined with respect to the tube axis AX to correspond to the inclination of the connection portion 622. According to this configuration, the intensity of an electric field generated in the vicinity of the connection portion 622 is further reduced. Therefore, electric discharge can be suitably curbed.

Hereinabove, the embodiment of the present invention has been described. The present invention is not limited to the foregoing embodiment. The present invention can be variously modified within a range not departing from the gist thereof.

For example, a chamfer may be provided in the corner portion between the anode main body portion 62 and the protrusion portion 63.

A surface formed through the chamfer may be a curved surface or may be a flat surface.

Figure 6A:
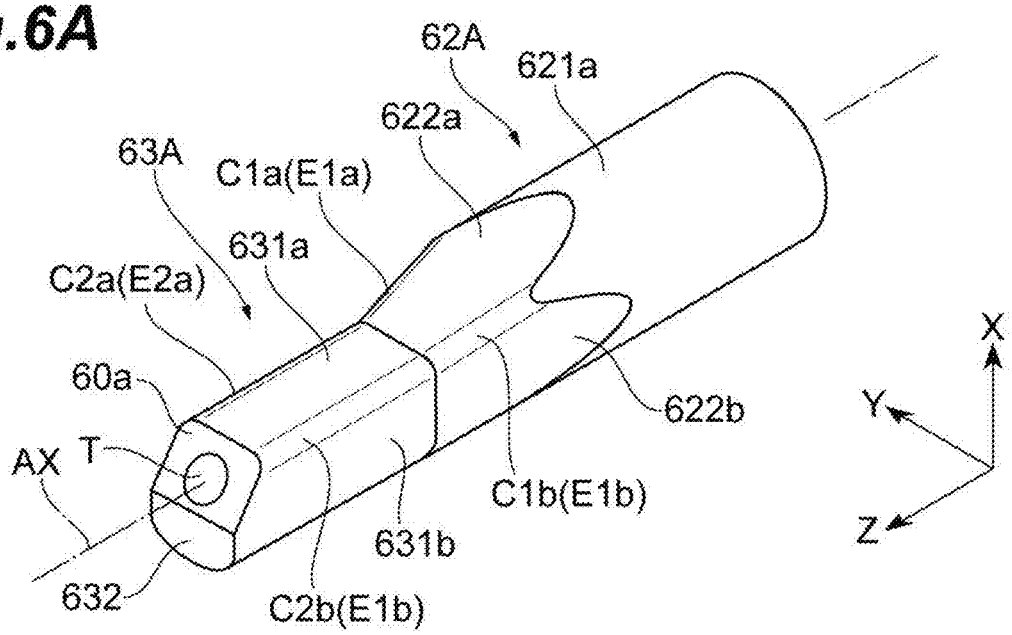
FIG. 6A is a perspective view illustrating an enlarged main portion of an anode included in an X-ray tube according to a first modification example.
Figure 6B:
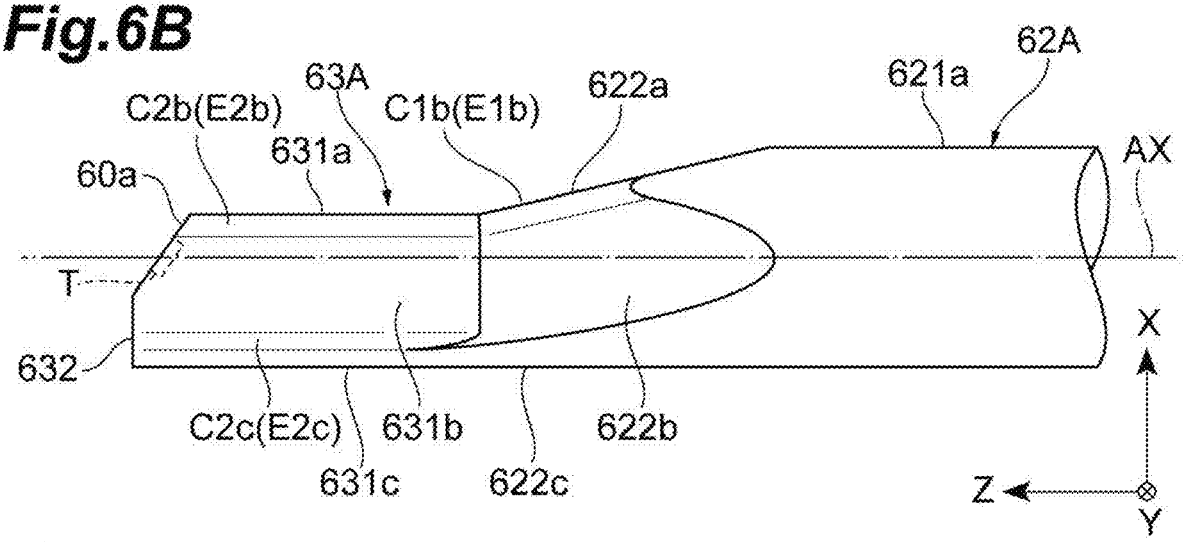
FIG. 6B is a side view illustrating the enlarged main portion of the anode included in the X-ray tube according to the first modification example.
Figure 6C:
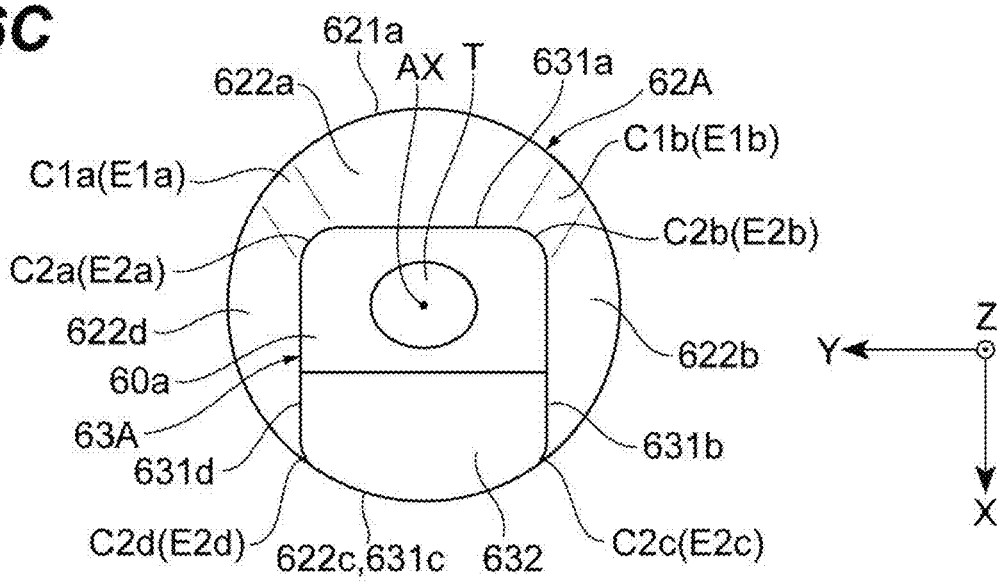
FIG. 6C is a front view illustrating the enlarged main portion of the anode included in the X-ray tube according to the first modification example.

[First modification example] As illustrated in FIGS. 6A, 6B, and 6C, an anode main body portion 62A has chamfers C1*a* and C1*b* (first chamfered portion). As illustrated in FIG. 6C, the chamfer C1*a* is provided in a corner portion E1*a*. The corner portion E1*a* causes the first connection surface 622*a* and the third connection surface 622*d* to be coupled to each other. The chamfer C1*b* is provided in a corner portion E1*b*. The corner portion E1*b* causes the first connection surface 622*a* and the second connection surface 622*b* to be coupled to each other.

A protrusion portion 63A has chamfers C2*a* and C2*b* (second chamfered portion), and C2*c* and C2*d*. The chamfer C2*a* is provided in a corner portion E2*a*. The corner portion E2*a* causes the second side surface 631*d* and the main surface 631*a* to be coupled to each other. The corner portion E2*a* is connected to the corner portion E1*a*. Therefore, the chamfer C2*a* is also connected to the chamfer C1*a*. The chamfer C2*b* is provided in a corner portion E2*b*. The corner portion E2*b* causes the main surface 631*a* and the first side surface 631*b* to be coupled to each other. The corner portion E2*b* is connected to the corner portion E1*b*. Therefore, the chamfer C2*b* is also connected to the chamfer C1*b*. The chamfer C2*c* is provided in a corner portion E2*c*. The corner portion E2*c* causes the first side surface 631*b* and the curved side surface 631*c* to be coupled to each other. The chamfer C2*d* is provided in a corner portion E2*d*. The corner portion E2*d* causes the curved side surface 631*c* and the second side surface 631*d* to be coupled to each other.

According to these configurations, the corner portions E1*a*, E1*b*, E2*a*, E2*b*, E2*c*, and E2*d* in which an electric discharge is likely to occur are rounded. As a result, places at which electric discharge is likely to occur are reduced. Therefore, electric discharge can be further curbed.

A jig is used when the X-ray tube 3 is assembled. For example, when the X-ray tube 3 is assembled, the central axis of the target supporting portion 60 is caused to coincide with the tube axis AX. In this case, the protrusion portion 63A is inserted into a jig having a rectangular hole. Owing to machining, a corner portion of the rectangular hole of the jig cannot be worked to have a rigorously acute angle. The corner portion of the rectangular hole is rounded due to the diameter of a cutter such as an end mill. The protrusion portion 63A has the chamfers C2*a*, C2*b*, C2*c*, and C2*d*. Consequently, the corner portion of the protrusion portion 63A can be easily inserted without interfering with the corner portion of the rectangular hole.

Figure 7A:
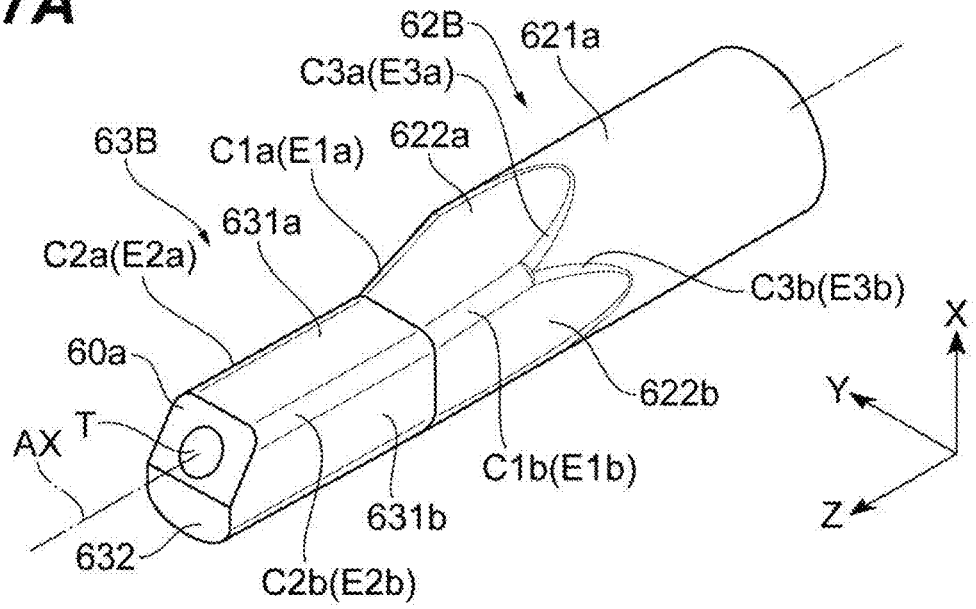
FIG. 7A is a perspective view illustrating an enlarged main portion of an anode included in an X-ray tube according to a second modification example.
Figure 7B:
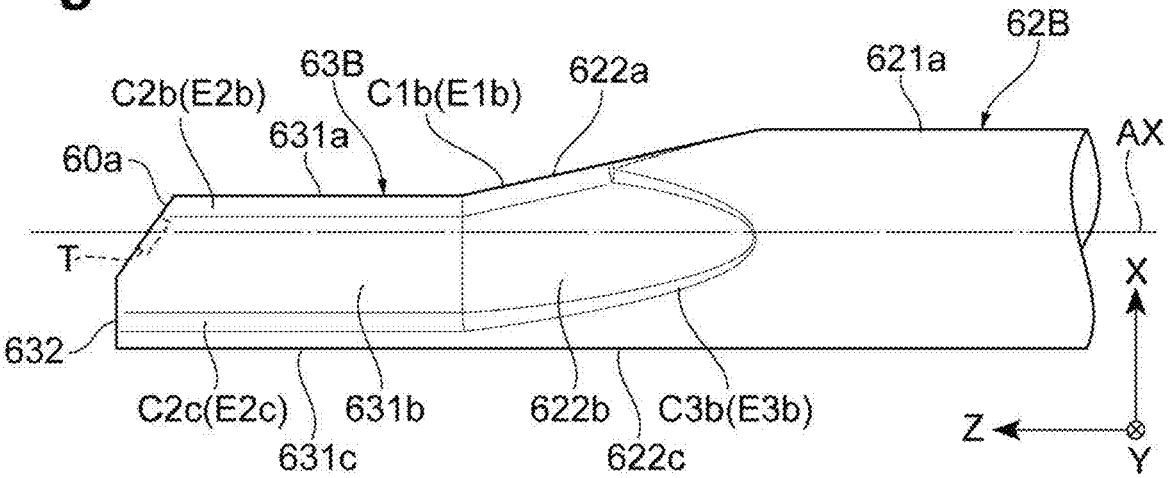
FIG. 7B is a side view illustrating the enlarged main portion of the anode included in the X-ray tube according to the second modification example.
Figure 7C:
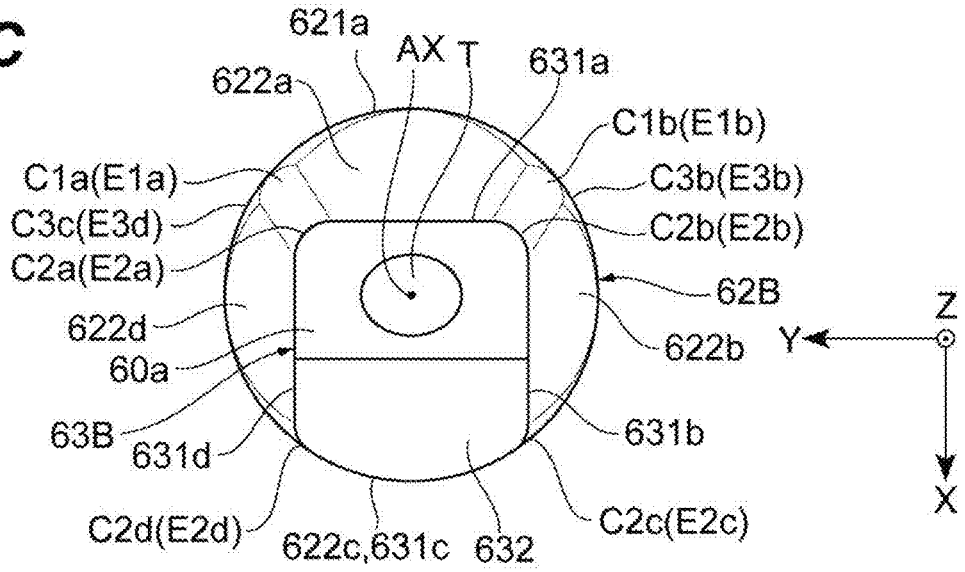
FIG. 7C is a front view illustrating the enlarged main portion of the anode included in the X-ray tube according to the second modification example.

[Second modification example] As illustrated in FIGS. 7A, 7B, and 7C, in addition to the chamfers C1*a* and C1*b* of the anode main body portion 62A, an anode main body portion 62B further has a chamfer C3*a* (third chamfered portion), C3*b* (fourth chamfered portion), and C3*c*. The chamfer C3*a* is provided in the edge portion E3*a*. One end of the arc-shaped chamfer C3*a* is connected to the chamfer C1*a*. The other end of the arc-shaped chamfer C3*a* is connected to the chamfer C1*b*. The chamfer C3*b* is provided in the edge portion E3*b*. One end of the arc-shaped chamfer C3*b* is connected to the chamfer C1*b*. The other end of the arc-shaped chamfer C3*b* is connected to the chamfer C2*c*. The chamfer C3*c* is provided in the edge portion E3*d*. One end of the arc-shaped chamfer C3*c* is connected to the chamfer C1*a*. The other end of the arc-shaped chamfer C3*c* is connected to the chamfer C2*d*. According to these configurations, places having an acute angle at which electric discharge is likely to occur are further reduced. Therefore, electric discharge can be more suitably curbed.

When the first connection surface 622*a*, the second connection surface 622*b*, and the third connection surface 622*d* are machined, burrs remain in the edge portions E3*a*, E3*b*, and E3*c* sometimes. In the anode main body portion 62B, the chamfers C3*a*, C3*b*, and C3*c* are provided respectively for the edge portions E3*a*, E3*b*, and E3*c*.

Therefore, burrs of the edge portions E3*a*, E3*b*, and E3*c* are removed. As a result, electric discharge can be further curbed.

What is claimed is:

1. An X-ray tube comprising:

a vacuum housing;

an electron gun that is accommodated in the vacuum housing and emits electrons; and an anode that includes a target which is accommodated in the vacuum housing, receives electrons provided from the electron gun, and emits X-rays, and a target supporting portion which supports the target, wherein the target supporting portion has a main body portion having a columnar shape which extends in a direction of an axis line, and a protrusion portion including a side surface portion which extends in the direction of the axis line from the main body portion, and an inclined surface which is connected to the side surface portion, which intersects the axis line, and in which the target is disposed, wherein the protrusion portion has a cross section intersecting the axis line with a smaller area than the main body portion, wherein the main body portion includes an outer circumferential surface extending in the direction of the axis line, and a connection portion formed between the side surface portion of the protrusion portion and the outer circumferential surface, wherein the side surface portion includes a main surface facing the electron gun, and a side surface intersecting the main surface, wherein the connection portion includes a first connection surface formed between the outer circumferential surface and the main surface, and a second connection surface formed between the outer circumferential surface and the side surface, and wherein the main body portion includes a connection chamfered portion formed between the first connection surface and the second connection surface.

2. The X-ray tube according to claim 1,
wherein the side surface intersecting the main surface is a pair of side surfaces intersecting the main surface,
wherein an angle formed by the outer circumferential surface and the connection portion is an obtuse angle,
wherein an angle formed by the outer circumferential surface and the first connection surface is an obtuse angle, and
wherein an angle formed by the outer circumferential surface and the second connection surface is an obtuse angle.

3. The X-ray tube according to claim 1,
wherein the protrusion portion includes a protrusion chamfered portion formed between the main surface and the side surface.

4. The X-ray tube according to claim 1,
wherein the main body portion includes
a first rod-like chamfered portion formed between the first connection surface and the outer circumferential surface, and
a second rod-like chamfered portion formed between the second connection surface and the outer circumferential surface.

5. The X-ray tube according to claim 1,
wherein an angle formed by the outer circumferential surface and the connection portion is smaller than an angle formed by a distal end surface and the inclined surface.

6. The X-ray tube according to claim 1,
wherein the axis line is a center axis line of the main body portion, and
wherein the target is disposed at a position intersecting the axis line.

7. The X-ray tube according to claim 1,
wherein the vacuum housing includes a metal housing portion which is formed of a metal and accommodates at least a part of the protrusion portion and the main body portion,
wherein the metal housing portion includes an inner circumferential surface portion facing the connection portion, and
wherein the inner circumferential surface portion is inclined with respect to the axis line to correspond to an inclination of the connection portion.

8. An X-ray tube comprising:
a vacuum housing;
an electron gun that is accommodated in the vacuum housing and emits electrons; and
an anode that includes a target which is accommodated in the vacuum housing, receives electrons provided from the electron gun, and emits X-rays, and a target supporting portion which supports the target,
wherein the target supporting portion has
a main body portion having a columnar shape which extends in a direction of an axis line, and
a protrusion portion including a side surface portion which extends in the direction of the axis line from the main body portion, and an inclined surface which is connected to the side surface portion, which intersects the axis line, and in which the target is disposed,
wherein the protrusion portion has a cross section intersecting the axis line with a smaller area than the main body portion,
wherein the main body portion includes
an outer circumferential surface extending in the direction of the axis line, and
a connection portion formed between the side surface portion of the protrusion portion and the outer circumferential surface,
wherein the vacuum housing includes a metal housing portion which is formed of a metal and accommodates at least a part of the protrusion portion and the main body portion,
wherein the metal housing portion includes an inner circumferential surface portion directly facing the connection portion,
wherein the inner circumferential surface portion is inclined with respect to the axis line to correspond to an inclination of the connection portion, and
wherein the metal housing portion comprises
a cylinder portion accommodating at least a part of the protrusion portion, and
a tapered portion connected to the cylinder portion and having a diameter gradually increasing out from the cylinder portion along the axis line, wherein the tapered portion includes an inner circumferential surface portion.

9. The X-ray tube according to claim 8,
wherein a side surface of the side surface portion intersecting a main surface of the side surface portion is a pair of side surfaces intersecting the main surface,
wherein an angle formed by the outer circumferential surface and the connection portion is an obtuse angle,
wherein an angle formed by the outer circumferential surface and a first connection surface of the connection portion is an obtuse angle, and
wherein an angle formed by the outer circumferential surface and a second connection surface of the connection portion is an obtuse angle.

10. The X-ray tube according to claim 8,
wherein an angle formed by the outer circumferential surface and the connection portion is smaller than an angle formed by a distal end surface and the inclined surface.

11. The X-ray tube according to claim 8,
wherein the axis line is a center axis line of the main body portion, and
wherein the target is disposed at a position intersecting the axis line.

12. The X-ray tube according to claim 8, wherein a gap perpendicular to the axis line between the connection portion and the tapered portion is substantially uniform along the axis line.

13. The X-ray tube according to claim 8,
wherein the side surface portion includes
a main surface facing the electron gun, and
a side surface intersecting the main surface,
wherein the connection portion includes
a first connection surface formed between the outer circumferential surface and the main surface, and
a second connection surface formed between the outer circumferential surface and the side surface, and
wherein the inner circumferential surface portion of the metal housing portion directly faces both of the first connection surface and the second connection surface.

14. An X-ray tube comprising:
a vacuum housing;
an electron gun that is accommodated in the vacuum housing and emits electrons; and
an anode that includes a target which is accommodated in the vacuum housing, receives electrons provided from the electron gun, and emits X-rays, and a target supporting portion which supports the target, wherein the target supporting portion has a main body portion having a columnar shape which extends in a direction of an axis line, and a protrusion portion including a side surface portion which extends in the direction of the axis line from the main body portion, and an inclined surface which is connected to the side surface portion, which intersects the axis line, and in which the target is disposed, wherein the protrusion portion has a cross section intersecting the axis line with a smaller area than the main body portion, wherein the main body portion includes an outer circumferential surface extending in the direction of the axis line, and a connection portion formed between the side surface portion of the protrusion portion and the outer circumferential surface, wherein the side surface portion includes a main surface facing the electron gun, and a side surface intersecting the main surface, and wherein the protrusion portion includes a protrusion chamfered portion formed between the main surface and the side surface.

15. The X-ray tube according to claim 14, wherein the side surface intersecting the main surface is a pair of side surfaces intersecting the main surface, wherein an angle formed by the outer circumferential surface and the connection portion is an obtuse angle, wherein an angle formed by the outer circumferential surface and a first connection surface of the connection portion is an obtuse angle, and wherein an angle formed by the outer circumferential surface and a second connection surface of the connection portion is an obtuse angle.

16. The X-ray tube according to claim 14, wherein an angle formed by the outer circumferential surface and the connection portion is smaller than an angle formed by a distal end surface and the inclined surface.

17. The X-ray tube according to claim 14, wherein the axis line is a center axis line of the main body portion, and wherein the target is disposed at a position intersecting the axis line.

18. The X-ray tube according to claim 15, wherein the vacuum housing includes a metal housing portion which is formed of a metal and accommodates at least a part of the protrusion portion and the main body portion, wherein the metal housing portion includes an inner circumferential surface portion facing the connection portion, and wherein the inner circumferential surface portion is inclined with respect to the axis line to correspond to an inclination of the connection portion.

19. The X-ray tube according to claim 14, wherein the connection portion includes a first connection surface formed between the outer circumferential surface and the main surface, and a second connection surface formed between the outer circumferential surface and the side surface, and wherein the main body portion includes a connection chamfered portion formed between the first connection surface and the second connection surface.

20. The X-ray tube according to claim 14, wherein the connection portion includes a first connection surface formed between the outer circumferential surface and the main surface, and a second connection surface formed between the outer circumferential surface and the side surface, and wherein the main body portion includes a first rod-like chamfered portion formed between the first connection surface and the outer circumferential surface, and a second rod-like chamfered portion formed between the second connection surface and the outer circumferential surface.

21. An X-ray tube comprising:

a vacuum housing;

an electron gun that is accommodated in the vacuum housing and emits electrons; and an anode that includes a target which is accommodated in the vacuum housing, receives electrons provided from the electron gun, and emits X-rays, and a target supporting portion which supports the target, wherein the target supporting portion has a main body portion having a columnar shape which extends in a direction of an axis line, and a protrusion portion including a side surface portion which extends in the direction of the axis line from the main body portion, and an inclined surface which is connected to the side surface portion, which intersects the axis line, and in which the target is disposed, wherein the protrusion portion has a cross section intersecting the axis line with a smaller area than the main body portion, wherein the main body portion includes an outer circumferential surface extending in the direction of the axis line, and a connection portion formed between the side surface portion of the protrusion portion and the outer circumferential surface, wherein the side surface portion includes a main surface facing the electron gun, and a side surface intersecting the main surface, wherein the connection portion includes a first connection surface formed between the outer circumferential surface and the main surface, and a second connection surface formed between the outer circumferential surface and the side surface, and wherein the main body portion includes a first rod-like chamfered portion formed between the first connection surface and the outer circumferential surface, and a second rod-like chamfered portion formed between the second connection surface and the outer circumferential surface.

22. The X-ray tube according to claim 21, wherein the side surface intersecting the main surface is a pair of side surfaces intersecting the main surface, wherein an angle formed by the outer circumferential surface and the connection portion is an obtuse angle, wherein an angle formed by the outer circumferential surface and the first connection surface is an obtuse angle, and wherein an angle formed by the outer circumferential surface and the second connection surface is an obtuse angle.

23. The X-ray tube according to claim 21, wherein an angle formed by the outer circumferential surface and the connection portion is smaller than an angle formed by a distal end surface and the inclined surface.

24. The X-ray tube according to claim 21, wherein the axis line is a center axis line of the main body portion, and wherein the target is disposed at a position intersecting the axis line.

25. The X-ray tube according to claim 21, wherein the vacuum housing includes a metal housing portion which is formed of a metal and accommodates at least a part of the protrusion portion and the main body portion, wherein the metal housing portion includes an inner circumferential surface portion facing the connection portion, and wherein the inner circumferential surface portion is inclined with respect to the axis line to correspond to an inclination of the connection portion.

26. The X-ray tube according to claim 21, wherein the main body portion includes a connection chamfered portion formed between the first connection surface and the second connection surface.

27. The X-ray tube according to claim 21, wherein the protrusion portion includes a protrusion chamfered portion formed between the main surface and the side surface.

* * * * *